US010069260B2

(12) United States Patent
Masel et al.

(10) Patent No.: US 10,069,260 B2
(45) Date of Patent: Sep. 4, 2018

(54) SUPPLY RAIL

(71) Applicant: Woehner GmbH & Co. KG Elektrotechnische Systeme, Roedental (DE)

(72) Inventors: Joram Masel, Kronach (DE); Christopher Curth, Neustadt (DE); Alexander Rahn, Coburg (DE)

(73) Assignee: Woehner GmbH & Co., KG Elektrotechnische Systeme, Roedental (DE)

( * ) Notice: Subject to any disclaimer, the term of this patent is extended or adjusted under 35 U.S.C. 154(b) by 0 days.

(21) Appl. No.: 15/329,115

(22) PCT Filed: Jul. 31, 2015

(86) PCT No.: PCT/EP2015/067631
§ 371 (c)(1),
(2) Date: Jan. 25, 2017

(87) PCT Pub. No.: WO2016/016417
PCT Pub. Date: Feb. 4, 2016

(65) Prior Publication Data

US 2017/0214199 A1 Jul. 27, 2017

(30) Foreign Application Priority Data

Aug. 1, 2014 (EP) ..... 14179581

(51) Int. Cl.
*H01R 25/00* (2006.01)
*H01R 25/16* (2006.01)
*H01R 13/447* (2006.01)

(52) U.S. Cl.
CPC ..... *H01R 25/162* (2013.01); *H01R 13/447* (2013.01)

(58) Field of Classification Search
CPC .... H01R 25/162; H01R 13/447; H01H 71/08; H01H 33/002; H02B 1/22; H02B 1/21; H02B 1/36; H02G 5/02
(Continued)

(56) References Cited

U.S. PATENT DOCUMENTS 2,297,170 A * 9/1942 Rudd ..... H02G 5/02 174/99 B
2,984,769 A * 5/1961 Turton ..... H01H 33/002 200/50.2

(Continued)

FOREIGN PATENT DOCUMENTS

DE 202010003375 U1 8/2010
EP 1045414 A1 10/2000
EP 2367192 A1 9/2011

OTHER PUBLICATIONS

International Search Report corresponding to international application No. PCT/EP2015/067631, dated Oct. 19, 2015 (3 pages).

*Primary Examiner* — Jean F Duverne
(74) *Attorney, Agent, or Firm* — Maginot, Moore & Beck, LLP

(57) ABSTRACT

Supply rail (1) for supplying current phases (L1, L2, L3) of a low-voltage network to a busbar system or for tapping current phases (L1, L2, L3) from the busbar system, comprising an elongate main body (2) that can be mounted transversely on a plurality of busbars arranged in parallel and includes contact bars (5-1, 5-2, 5-3) that contact the busbars when the supply rail (1) is mounted in order to supply or to tap the current phases (L1, L2, L3) carried on the busbars, wherein each contact bar (5-1, 5-2, 5-3) is directly connected to an associated terminal bus (11-1, 11-2, 11-3), each of which comprises a terminal at an end face of the elongate main body (2) for electrically connecting to the low-voltage network.

31 Claims, 17 Drawing Sheets

(58) Field of Classification Search
USPC ..... 439/110
See application file for complete search history.

(56) References Cited

U.S. PATENT DOCUMENTS

| | | | | |
|---|---|---|---|---|
| 2,999,190 | A * | 9/1961 | Armandroff | H02B 1/21 174/59 |
| 3,470,422 | A * | 9/1969 | Lameyre | H02B 1/36 361/608 |
| 9,118,170 | B2 * | 8/2015 | Narin | H02B 1/22 |
| 2010/0133078 | A1 * | 6/2010 | Majewski | H01H 71/08 200/293 |

* cited by examiner

SUPPLY RAIL

This application is a 35 U.S.C. 371 National Stage application of PCT/EP2015/067631, filed Jul. 31, 2015 and claiming priority to European Application No. EP14179581.5, filed on Aug. 1, 2014. The entire contents of the above-mentioned patent applications are incorporated herein by reference as part of the disclosure of this U.S. application.

The invention relates to a supply rail for supplying current phases of a low-voltage network to a busbar system or for tapping current phases from a busbar system.

In conventional busbar systems, terminals have mostly been used up to now for supplying current phases of a low-voltage network to the busbar system. This is disadvantageous firstly in that connecting the low-voltage network to the busbar system requires a relatively high amount of assembly work and incorrect connections can also occur. In addition, using conventional terminals does not provide reliable protection against accidental contact, and so extra contact-prevention measures have to be taken.

The object of the present invention is therefore to provide a supply rail for supplying current phases of a low-voltage network to a busbar system, by which the electrical connection between the low-voltage network and the busbar system can be established in a simple and safe manner.

This object is achieved according to the invention by a supply rail having the features set out in claim 1.

Accordingly, the invention provides a supply rail for supplying current phases of a low-voltage network to a busbar system or for tapping current phases from the busbar system, comprising an elongate main body that can be mounted transversely on a plurality of busbars arranged in parallel and incudes contact bars that contact the busbars when the supply rail is mounted in order to supply or to tap the current phases carried on the busbars, wherein each contact bar is directly connected to an associated terminal bus, each of which comprises a terminal at an end face of the elongate main body for electrically connecting to the low-voltage network.

Alternatively, the contact bars can also be connected to the busbars by means of an intermediate contact piece, such as a comb contact.

The supply rail is advantageous in that the power loss occurring thereon owing to the direct connection between the busbar system and the low-voltage network is low.

In one possible embodiment of the supply rail according to the invention, each contact bar is connected to an associated terminal bus by means of a corresponding connector plate.

In one possible embodiment of the supply rail according to the invention, the contact bars, the terminal buses and, if provided, the connector plates are covered by contact guard covers.

This has the advantage that users cannot touch the voltage-carrying or current-carrying bars, increasing safety for users.

In another possible embodiment of the supply rail according to the invention, the contact guard covers are formed by a plastics part.

This simplifies or speeds up replacement of the contact guard covers.

In an alternative embodiment of the supply rail according to the invention, the contact guard covers are formed by a plurality of separate plastics parts.

This embodiment is advantageous in that users can separately inspect the supply rail regions intended for the various current phases by removing the relevant contact guard cover.

In another possible embodiment of the supply rail according to the invention, the elongate main body of the supply rail comprises releasable connecting elements for mechanically connecting the contact guard covers to the elongate main body.

In another possible embodiment of the supply rail according to the invention, the connector plates each comprise an opening in the centre thereof for mounting the supply rail on the busbar system.

This provides the advantage of being able to mount the supply rail on the busbar system in a particularly simple manner since the screws and nuts for establishing the contact can be accessed using a tool.

In another possible embodiment of the supply rail according to the invention, the contact bars, the terminal buses and the connector plates consist of a conductive material having low electrical power loss.

In another possible embodiment of the supply rail according to the invention, the terminals for the low-voltage network that are located on the end face of the elongate main body each comprise terminal lugs.

In another possible embodiment of the supply rail according to the invention, the elongate main body of the supply rail is shaped such that it comprises separate receiving channels, which extend in the longitudinal direction, for the terminal buses, inserted into the main body, for the various current phases.

In one possible embodiment of the supply rail according to the invention, said rail comprises three contact bars for three current phases of the busbar system, which bars are connected to three associated terminal buses either directly or by means of three connector plates.

In another possible embodiment of the supply rail according to the invention, the supply rail can be mounted transversely on the busbars arranged in parallel, wherein the end face of the elongate main body that has the terminal buses for electrically connecting to the low-voltage network points downwards.

In an alternative embodiment of the supply rail according to the invention, the supply rail can be mounted transversely on the busbars arranged in parallel, wherein the end face of the elongate main body that has the terminals for electrically connecting to the low-voltage network points upwards in a manner rotated by 180°.

In another possible embodiment of the supply rail according to the invention, the terminals for electrically connecting to the low-voltage network each comprise at least one option for fastening cable shoes, in particular stay bolts or nuts.

In another possible embodiment of the supply rail according to the invention, the terminal lugs of the terminals each comprise a clamp for electrically connecting to a round conductor or a segmental conductor, or a clamp for electrically connecting to a flat conductor.

In another possible embodiment of the supply rail according to the invention, the electrical current supplied via the supply rail has a high nominal amperage of more than 1000 A.

In another possible embodiment of the supply rail according to the invention, the elongate main body of the supply rail consists of an electrically insulating plastics part.

In another possible embodiment of the supply rail according to the invention, the contact bars comprise holes or semi-circular or slot-like notches for fastening to the associated busbar of the busbar system.

In another possible embodiment of the supply rail according to the invention, a support bracket for supporting a contact guard cover plate of a switch cabinet is attached to or integrated in one or both end faces of the elongate main body of the supply rail. This bracket can also be attached to or integrated in the side or on the contact guard covers.

In the following, possible embodiments of the supply rail according to the invention will be explained in more detail with reference to the accompanying drawings, in which.

Figure 1:
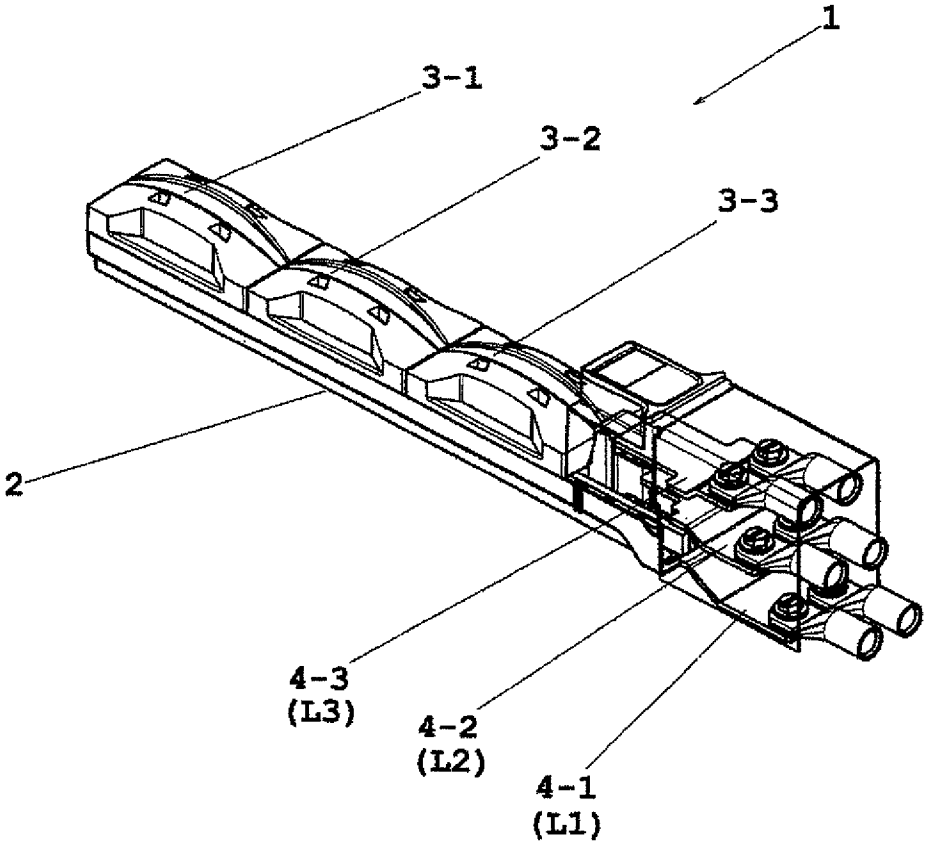
FIG. 1 is a perspective view of an embodiment of a supply rail according to the invention.
Figure 17:
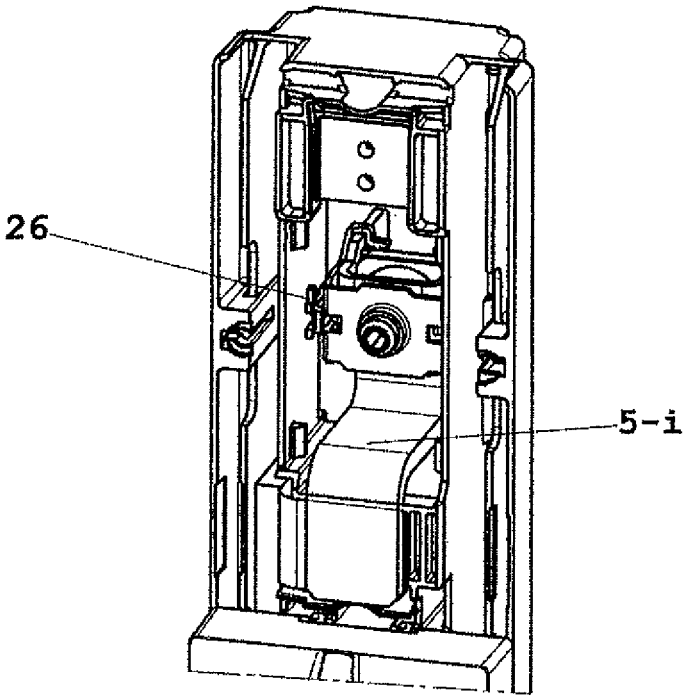
FIG. 17 is a detailed view illustrating a variant for mounting the supply rail according to the invention.

The supply rail 1 shown in perspective in FIG. 1 is used for supplying current phases of a low-voltage network to a busbar system or for tapping current phases from the busbar system. In the embodiment shown, the supply rail 1 comprises an elongate body 2 that can be mounted transversely on a plurality of busbars of the busbar system, which are arranged in parallel. The main body 2 includes contact bars 5-*i* which, when the supply rail 1 is mounted, contact the busbars for supplying or tapping the current phases carried on the busbars. The contact can also be established by means of an intermediate contact 26 (e.g. a comb contact), as shown in FIG. 17. In the process, each contact bar 5-*i* is directly connected to an associated terminal bus 11-*i*, each of which comprises a terminal at an end face of the elongate main body 2 for electrically connecting to the low-voltage network. In a possible variant, the connection can also be established by screwing, welding, soldering or the like. The current phases can be supplied to the busbar system by means of a 100 mm-wide supply rail 1, for example. In a possible variant, a main body of an NH load breaker rail can be used as the main body 2. In this way, a width of 100 mm can be produced for the three-phase supply of three current phases L1, L2, L3. The various current phases L1, L2, L3 are covered by contact guard covers 3-1, 3-2, 3-3. These contact guard covers can consist of single-part or multi-part plastics parts. The contact guard covers 3-*i* can be symmetrical or asymmetrical. In one possible embodiment, the contact guard covers 3-*i* are locked in the main body 2 and can only be removed using a tool, in particular a screwdriver. In one possible embodiment of the supply rail 1 according to the invention, each contact bar is connected to the associated terminal bus by means of a corresponding connector plate. In this case, the connector plates are preferably each covered by a contact guard cover 3-*i*. The elongate main body 2 of the supply rail 1 comprises releasable connecting elements, in particular catch elements, for mechanically connecting the contact guard covers 3-*i* to the elongate main body 2. Alternatively, the contact guard covers 3-*i* can comprise catch elements.

In the embodiment shown in FIG. 1, the supply rail is used for supplying or tapping three current phases L1, L2, L3, an associated electrical terminal 4-1, 4-2, 4-3 being provided for each current phase L1, L2, L3 on the end face of the elongate main body 2. The contact guard covers 3-*i* can be formed by an integral plastics part or by a plurality of separate plastics parts. The contact guard covers 3-*i* are planar and, after being released using a tool, can be removed by hand to inspect the arrangement therebelow.

Alternatively, the contact guard covers can also be designed such that they form a bearing surface or bearing edge for the cover system of the associated switch cabinet.

Figure 2:
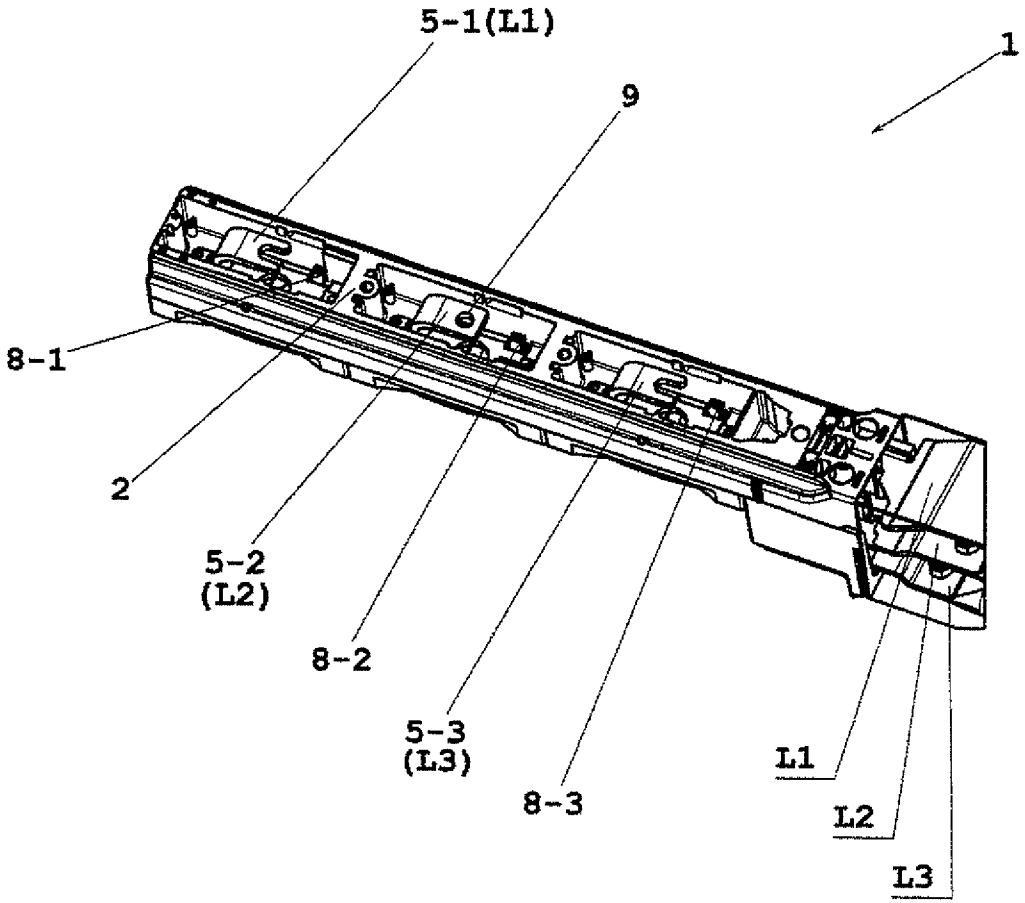
FIG. 2 is a view of the underside of the supply rail according to the invention, including contact guard covers (the contact bars for contacting the busbars can be seen)

FIG. 2 shows the underside of the embodiment of the supply rail 1 shown in FIG. 1, in the region of the busbar contact. In FIG. 2, three contact bars 5-1, 5-2, 5-3 can be seen. When the supply rail 1 is mounted, these contact bars contact the busbars of the busbar system in order to supply or to tap the current phases carried on the busbars. Latching elements 8-1, 8-2, 8-3 for latching the contact guard covers 3-1, 3-2, 3-3 into the main body 2 can also be seen in FIG. 2. The side contact bars 5-1, 5-3 comprise notches and the centrally arranged contact bar 5-2 comprises a hole 9 for positioning on the busbars, as can be seen in FIG. 2.

Figure 3:
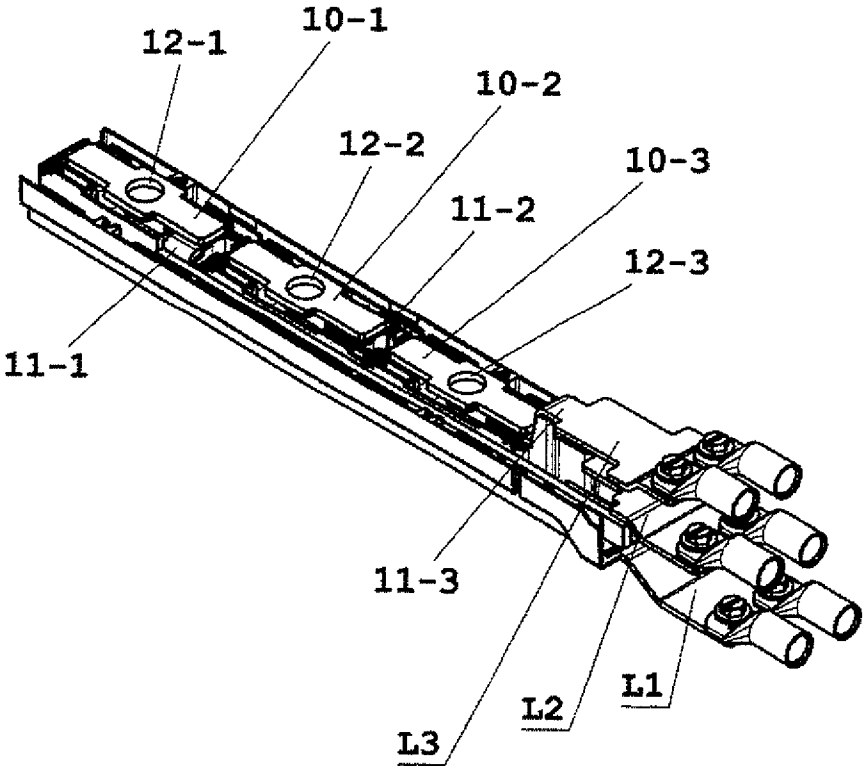
FIG. 3 is another perspective view of an embodiment of the supply rail according to the invention, with the contact guard covers removed to show the connector plates contained therein.
Figure 4:
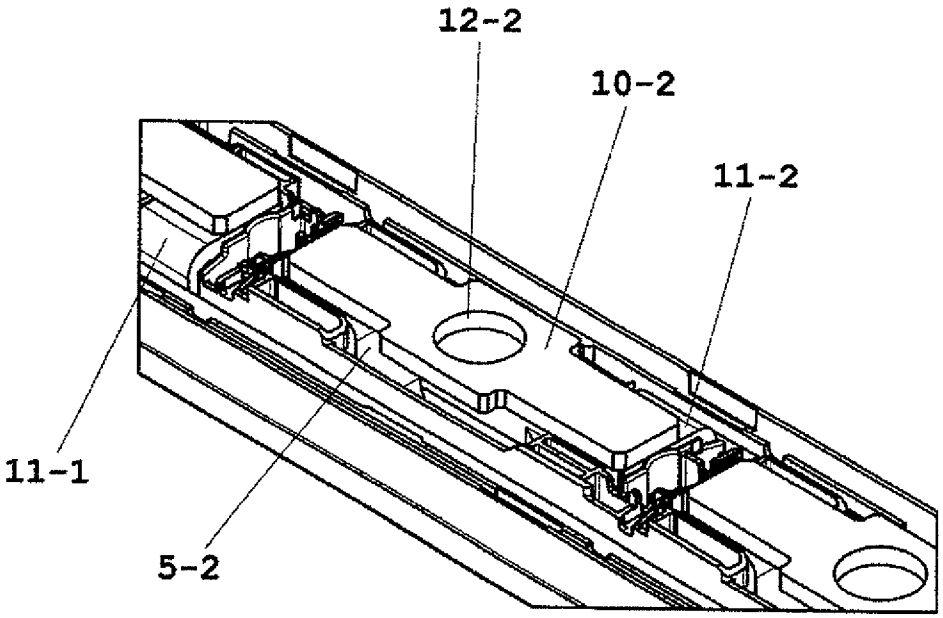
FIG. 4 is a detailed view of one of the connector plates shown in FIG. 3.
Figure 5:
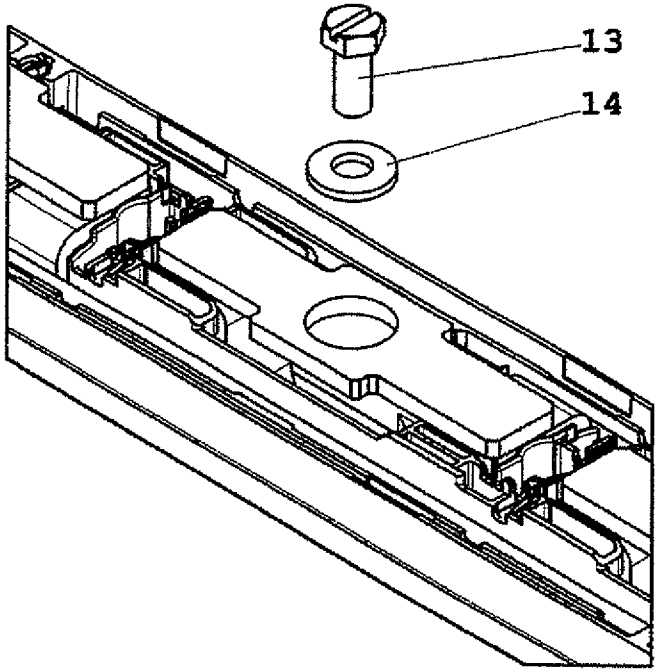
FIG. 5 is an illustration showing how the supply rail according to the invention is mounted on a busbar system.

FIG. 3 shows a variant of the supply rail 1 according to the invention in which each contact bar 5-1, 5-2, 5-3 is connected to the associated terminal bus 11-1, 11-2, 11-3 by means of a corresponding connector plate 10-1, 10-2, 10-3. In a possible variant, the connection can also be established by screwing, welding, soldering or the like. The connection between the contact bars 5-*i* and the associated terminal buses 11-*i* preferably cannot be released. Since the connections are not releasable and customers have to screw the supply rail 1 onto the busbar system, an associated mounting hole 12-1, 12-2, 12-3 is provided in the centre of each connector plate 10-1, 10-2, 10-3, as can also be seen in detail in FIG. 4. In a possible embodiment, users or customers can fasten the supply rail 1 to the busbar system by means of a hex screw 13 and a clamping plate 14, as shown in FIG. 5. Alternatively, mounting is also possible by means of a clamping clip. This clamping clip, including a comb contact, makes the supply rail 1 compatible with the busbar system equipped with contact guards. In the variants of the supply rail 1 according to the invention shown in FIGS. 3, 4 and 5, the contact bars 5-*i* and the associated terminal or output buses 11-*i* are connected by means of connector plates 10-*i*.

Figure 6:
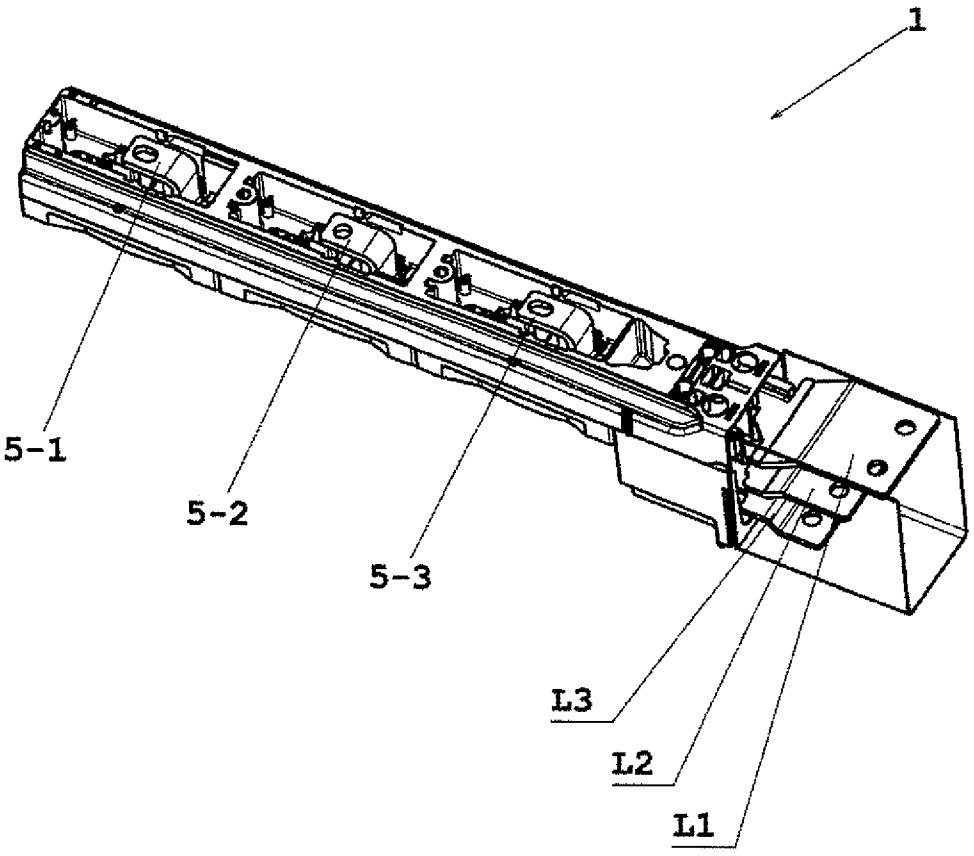
FIG. 6 is another perspective view from below illustrating an embodiment of the supply rail according to the invention.
Figure 7:
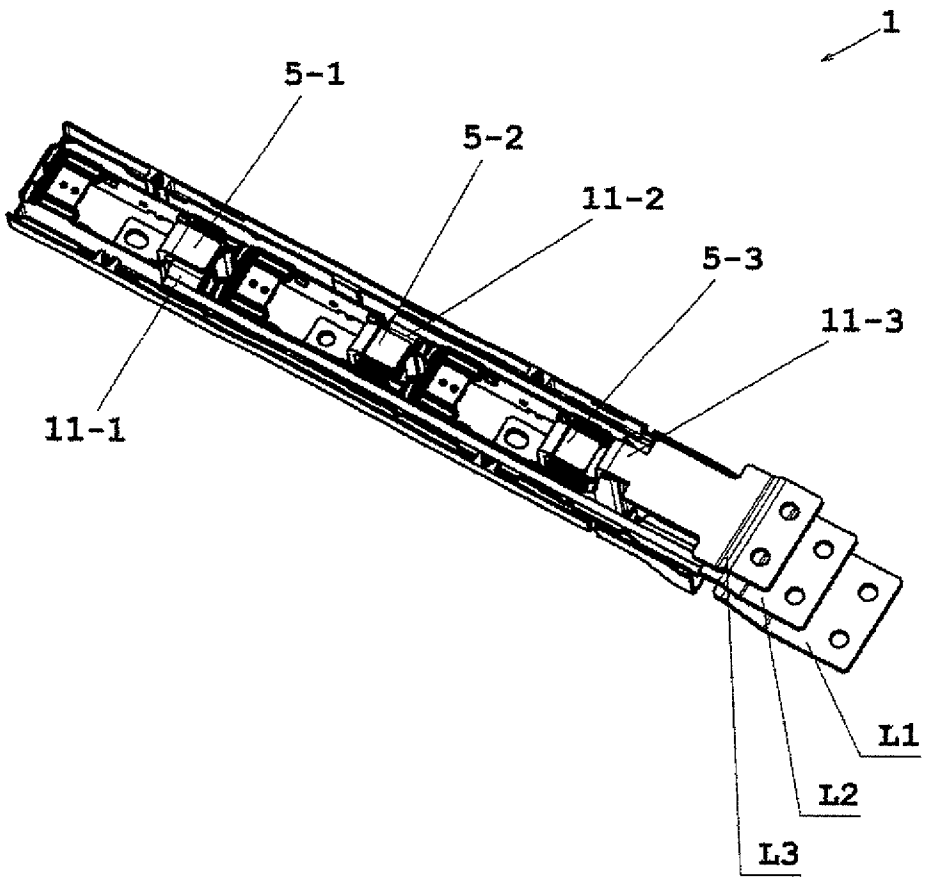
FIG. 7 is a perspective view from above of the supply rail with the contact guard covers removed.
Figure 8:
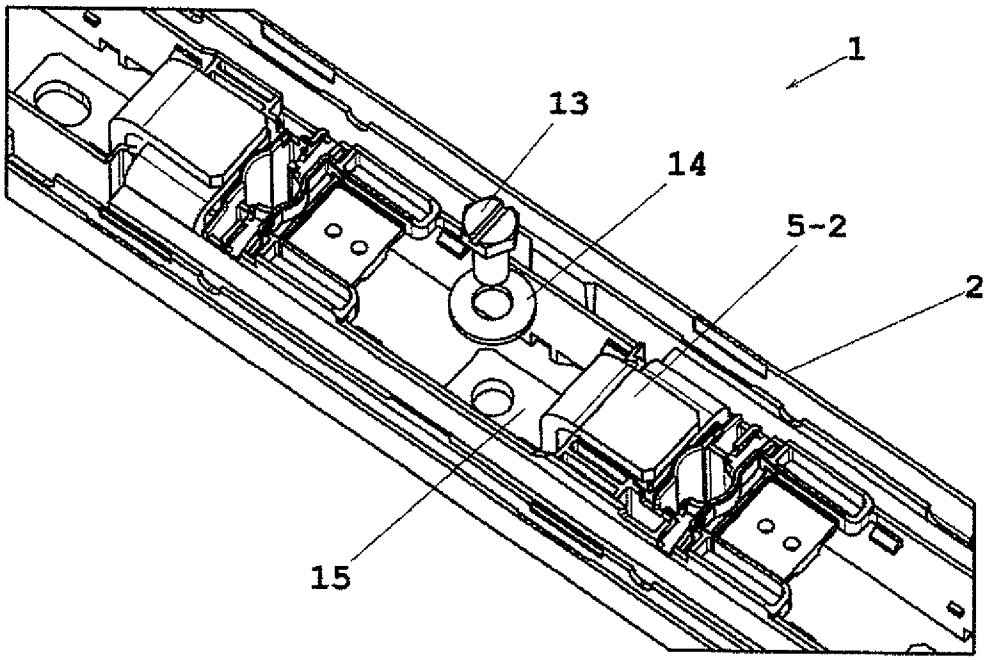
FIG. 8 is a detailed view illustrating how the supply rail according to the invention is mounted on the busbars.

In an alternative variant, there is a direct connection between the contact bars 5-*i* and the terminal buses 11-*i*. This variant is shown in FIGS. 6, 7 and 8. FIG. 6 shows the three access bars 5-1, 5-2, 5-3 for contacting the busbar of the busbar system. FIG. 7 shows the supply rail 1 shown in FIG. 6, rotated along the longitudinal axis. It can be seen that the contact bars **5-*i* are directly connected to the terminal buses or output buses 11-*i*. In this variant of the supply rail 1, it is easier for users or customers to screw the supply rail 1 to the busbar system, as shown in FIG. 8. FIG. 8 shows a hex nut 13 together with an associated clamping plate 14 for screwing the supply rail 1 through a hole 15 in the second contact bar 5-2**.

The terminal buses or output buses used within the main body 2 of the supply rail 1 can consist of a plurality of interconnected parts. It is thus also possible to bend the terminal buses or output buses out of a metal part. The supply rail 1 according to the invention can also be used as an output rail for tapping current phases from the busbar system.

Figure 9:
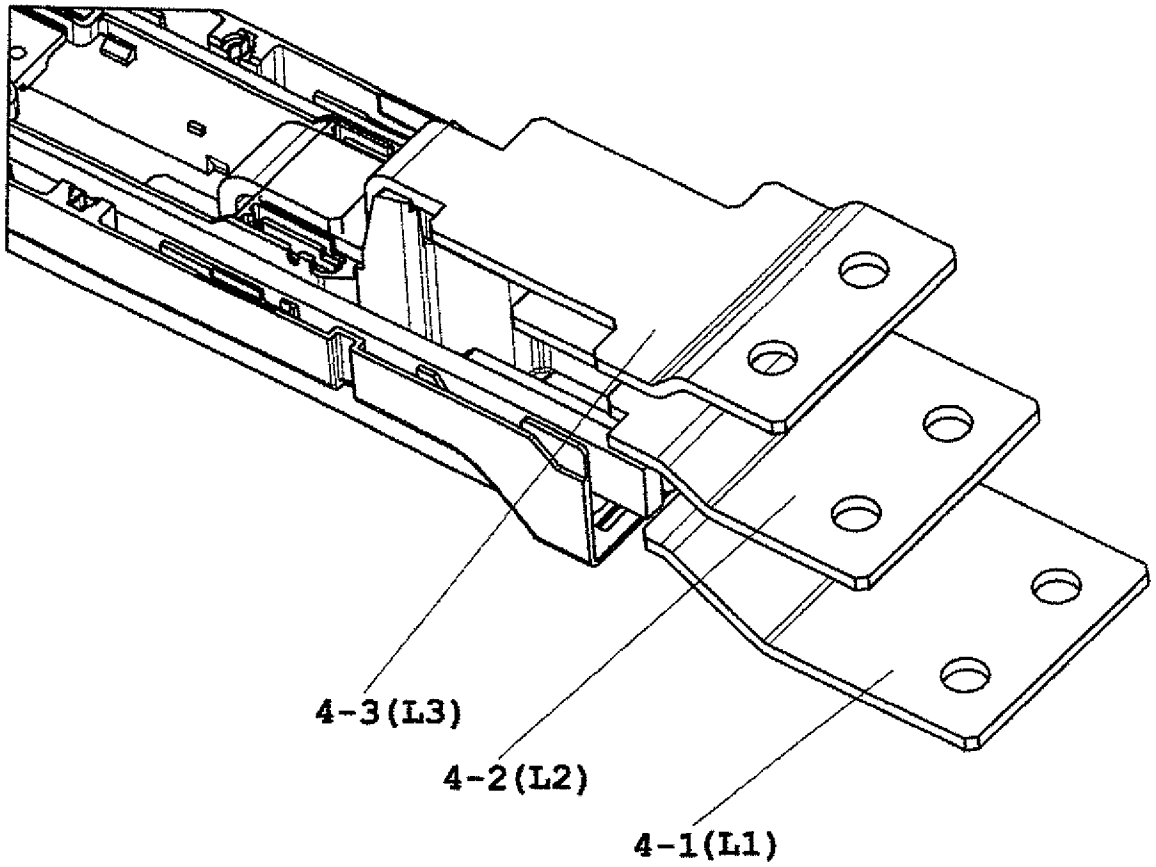
FIG. 9 is a detailed view showing a connection variant for the supply rail according to the invention.

In one possible embodiment of the supply rail according to the invention, it comprises terminals 4-1, 4-2, 4-3 in the form of terminal lugs, as shown in FIG. 9. To provide customers with flexible connection options in this area, different connection variants are possible, as shown in FIGS. 10, 11, 12, 13 and 14.

Figure 10:
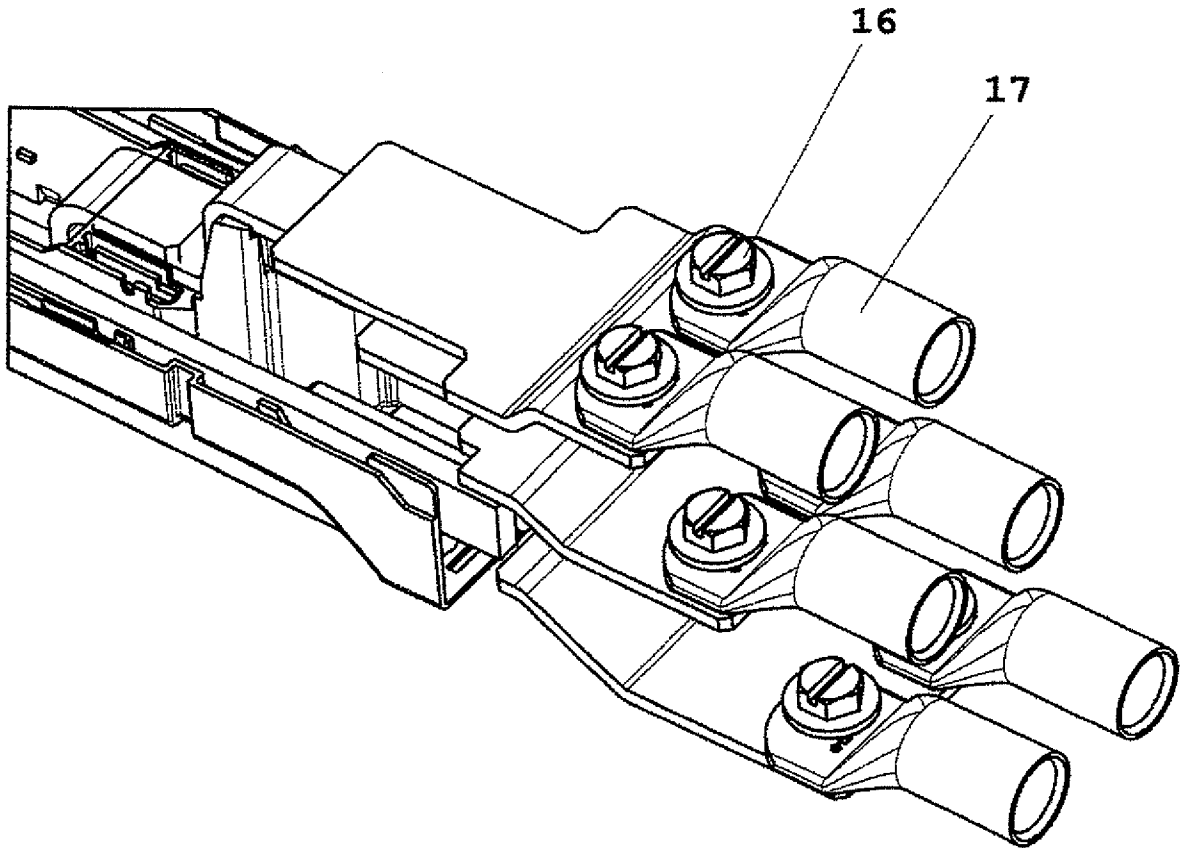
FIG. 10 is a detailed view illustrating the connection variant for the supply rail according to the invention as shown in FIG. 9, with cable shoes mounted.
Figure 11:
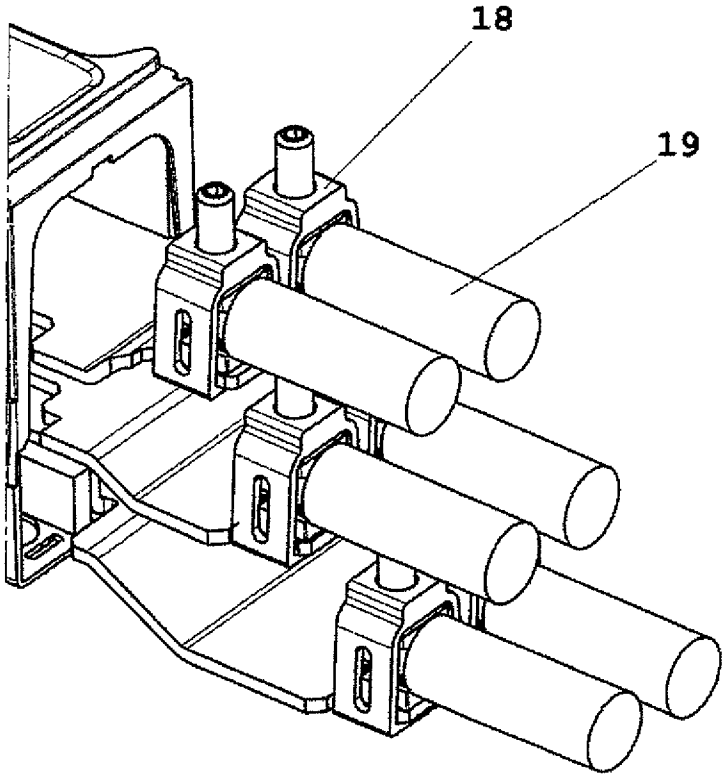
FIG. 11 is a detailed view illustrating another connection variant for the supply rail according to the invention.
Figure 12:
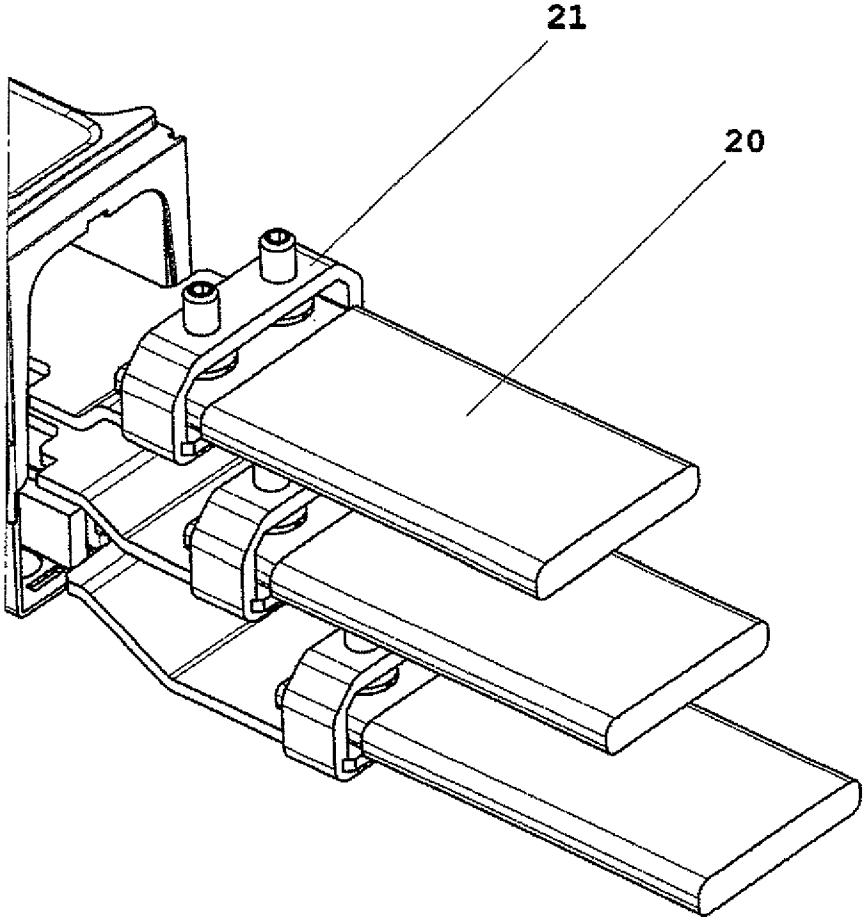
FIG. 12 is a detailed view illustrating another connection variant for the supply rail according to the invention.
Figure 13:
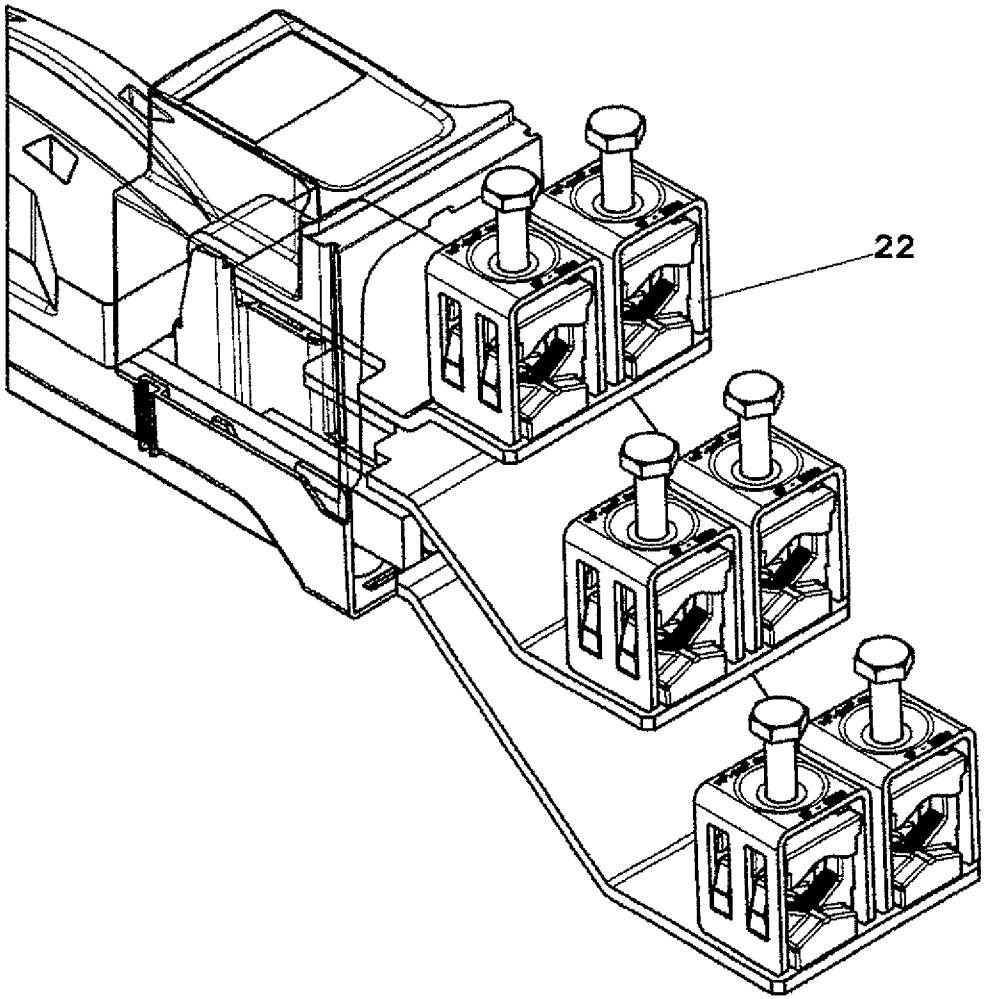
FIG. 13 is a detailed view illustrating another connection variant for the supply rail according to the invention.
Figure 14:
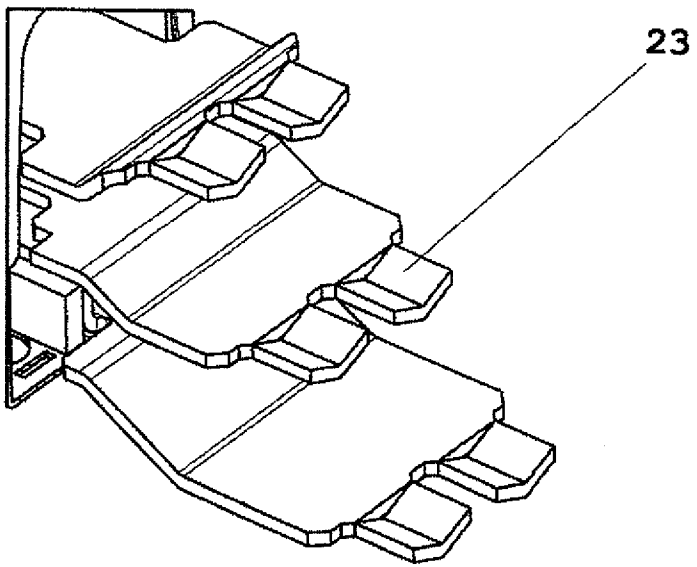
FIG. 14 is a detailed view illustrating another connection variant of the supply rail according to the invention.

As shown in FIG. 10, cable shoes 17 can be screwed onto the terminal lugs **4-*i* by means of hex screws 16. For example, two 300 $mm^2$ cable shoes 17 can be connected. FIG. 11 shows how the supply rail 1 can be operated using aluminium clamps 18. In this way, various round or segmental conductors 19 can be connected. In another variant, it is possible to fasten flat conductors 20 up to a width of for example 80 mm using clamps 21. It is also possible to screw on flat conductors, for example by means of a hex screw. Furthermore, in a variant as shown in FIG. 13, a universal conductor terminal 22 can be mounted on the terminal lugs of the supply rail 1. This allows users to use conductors of different conductor cross sections. In a possible variant, as shown in FIG. 14, a V-type direct terminal clamp 23 can be provided on the terminal lugs. This variant is especially suited for aluminium conductors. FIG. 14 shows a V-type direct connection clamp 23** of this kind.

The supply rail 1 according to the invention can be mounted transversely on the busbars arranged in parallel. In a possible mounting variant, the end face of the elongate main body 2 that has the connections for electrically connecting to the low-voltage network can point downwards. Alternatively, the supply rail can also be mounted on the parallel busbars in a manner rotated by 180°, wherein in this mounting variant the end face that has the connections for electrically connecting to the low-voltage network points upwards.

Figure 15:
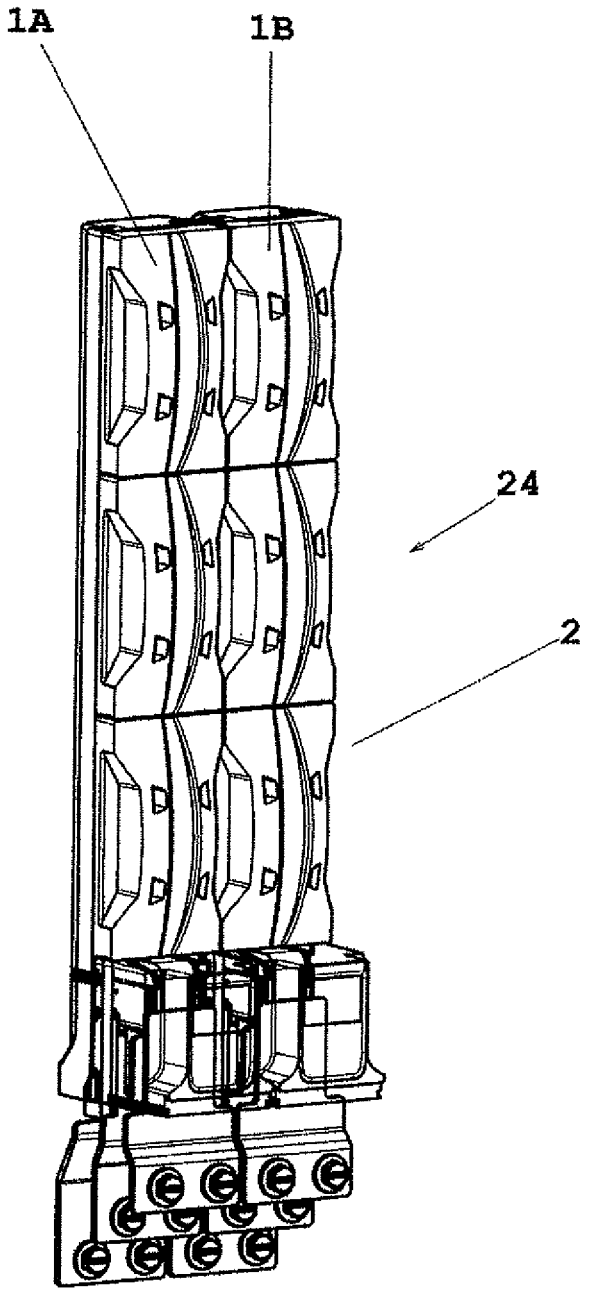
FIG. 15 is a view of an arrangement comprising a double supply rail consisting of supply rails.

FIG. 15 shows another variant—a double supply rail having a width of 200 mm. The double supply rail 24 shown in FIG. 15 comprises two supply rails 1A, 1B integrated in one body. Two separate bodies can also be used, as in a single supply rail. In a double rail, the terminals **4-*i* can be interconnected. Higher currents can be carried by the double supply rail 24 shown in FIG. 15 than by a single supply rail 1. In one possible embodiment, the electrical current supplied via the supply rail 1 has a high current amplitude of more than 1000 A. The contact bars, connector plates and output buses are designed accordingly. Even higher currents can be carried by the double supply rail 24 shown in FIG. 15. In the variant shown in FIG. 15, the terminal lugs of the double supply rail 24 are interconnected by a metal part. It is also possible to line up further supply rails. In other variants, further supply rails 1** can be integrated in a main body to further increase the permissible currents.

Figure 16:
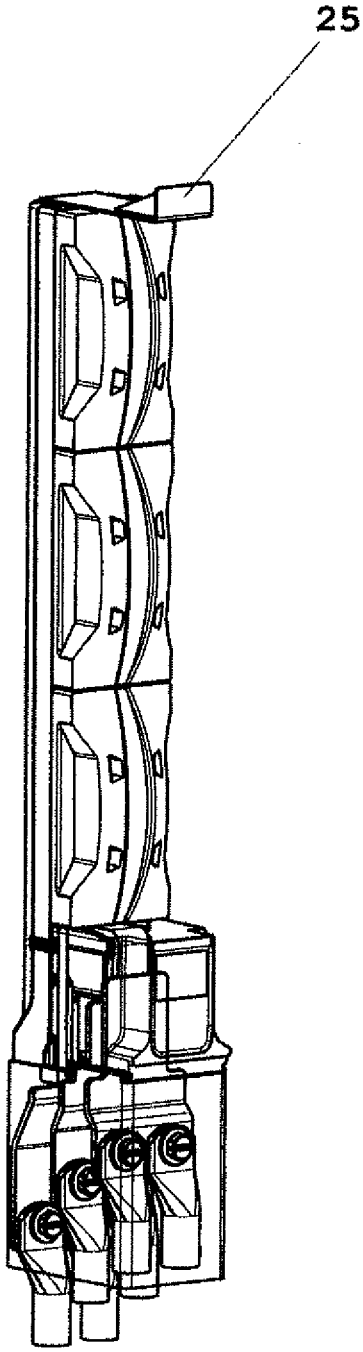
FIG. 16 is a view of a variant of the supply rail according to the invention comprising support brackets.

FIG. 16 shows a supply rail 1 that can be used in combination with an NH load breaker rail. In this case, a support bracket 25 is provided at the top of the end face of the main body. This add-on part allows customers or users to re-use a cover plate for preventing accidental contact in a switch cabinet.

The main body 2 of the supply rail 1 preferably consists of a light, fire-resistant and electrically insulating plastics material. The elongate main body 2 of the supply rail 1 is preferably shaped such that it comprises separate receiving channels, which extend in the longitudinal direction, for the terminal buses **11-*i*, inserted in the main body, for the various current phases L. The contact bars 5-*i*, connector plates 10-*i* and terminal buses 11-*i* preferably consist of an electrically conductive metal having low power loss, for example copper. In a possible variant, an electrical converter can also be mounted over the contact bars. In one possible embodiment, a plurality of separate supply rails 1 can be coupled together to increase the supply current. The busbars can be tapped by means of a clamping contact or a screw contact. The busbars can be contacted by the contact bars 5-*i* directly, as shown in FIG. 8, or indirectly by means of an intermediate piece 26, as shown in FIG. 17**.

The invention claimed is:

1. A supply rail for supplying current phases of a low-voltage network to a busbar system or for tapping current phases from the busbar system, comprising:

an elongate main body is configured to be mounted transversely on a plurality of busbars arranged in parallel and includes contact bars that contact the busbars either directly or by means of an intermediate piece when the supply rail is mounted, in order to supply or to tap the current phases carried on the busbars, wherein each contact bar is directly connected to an associated terminal bus includes, and wherein each terminal bus a terminal at an end face of the elongate main body for electrically connecting to the low-voltage network.

2. The supply rail according to claim 1, wherein each contact bar and/or each connector plate is covered by a contact guard cover.

3. The supply rail according to claim 2, wherein the contact guard covers are formed by one or more plastics parts.

4. The supply rail according to claim 2, wherein the elongate body of the supply rail comprises releasable connecting elements for mechanically connecting the contact guard covers to the elongate main body.

5. The supply rail according to claim 1, wherein the contact bars and the terminal buses consist of a conductive material having low electrical power loss.

6. The supply rail according to claim 1, wherein the terminals for the low-voltage network that are located on the end face of the elongate main body each comprise terminal lugs.

7. The supply rail according to claim 1, wherein the elongate main body of the supply rail is shaped such that it comprises separate receiving channels, which extend in the longitudinal direction, for the terminal buses, inserted into the main body, for the various current phases.

8. The supply rail according to claim 1, wherein the supply rail comprises three contact bars for three current phases of the busbar system, which bars are directly connected to three associated terminal buses.

9. The supply rail according to claim 8, wherein the supply rail is configured to be mounted transversely on the busbars arranged in parallel, wherein the end face of the elongate main body that has the terminals for electrically connecting to the low-voltage network points downwards or configured to be mounted on the parallel busbars in a manner rotated about 180°, wherein the end face of the elongate body that has the terminals for electrically connecting to the low-voltage network points upwards.

10. The supply rail according to claim 1, wherein the terminals for electrically connecting to the low-voltage network are each provided for at least one cable shoe that is configured to be attached to the terminal lug of the associated terminal.

11. The supply rail according to claim 1, wherein the terminal lugs of the terminals each comprise a clamp for electrically connecting to a round or segmental conductor or a clamp for electrically connecting to a flat conductor.

12. The supply rail according to claim 1, wherein the electrical current supplied via the supply rail has a high current amplitude of more than 1000 A.

13. The supply rail according to claim 1, wherein the elongate main body of the supply rail consists of an electrically insulating plastics part.

14. The supply rail according to claim 1, wherein the contact bars comprise holes or semi-circular notches for fastening to the associated busbar of the busbar system.

15. The supply rail according to claim 1, wherein support brackets for supporting a contact guard cover plate of a switch cabinet are provided on at least one side of the elongate main body or of the contact guard cover of the supply rail.

16. A supply rail for supplying current phases of a low-voltage network to a busbar system or for tapping current phases from the busbar system, comprising:

an elongate main body configured to be mounted transversely on a plurality of busbars arranged in parallel and includes contact bars that contact the busbars either directly or by means of an intermediate piece, when the supply rail is mounted, in order to supply or to tap the current phases carried on the busbars, wherein each contact bar is connected to an associated terminal bus by means of a corresponding connector plate, and wherein each terminal bus comprises a terminal at an end face of the elongate main body for electrically connecting to the low-voltage network.

17. The supply rail according to claim 16, wherein each contact bar and/or each connector plate is covered by a contact guard cover.

18. The supply rail according to claim 17, wherein the contact guard covers are formed by one or more plastics parts.

19. The supply rail according to claim 17, wherein the elongate body of the supply rail comprises releasable connecting elements for mechanically connecting the contact guard covers to the elongate main body.

20. The supply rail according to claim 16, wherein each connector plate has an opening in the centre thereof for mounting the supply rail on the busbar system.

21. The supply rail according to claim 16, wherein the contact bars, the terminal buses and the connector plates consist of a conductive material having low electrical power loss.

22. The supply rail according to claim 16, wherein the terminals for the low-voltage network that are located on the end face of the elongate main body each comprise terminal lugs.

23. The supply rail according to claim 16, wherein the elongate main body of the supply rail is shaped such that it comprises separate receiving channels, which extend in the longitudinal direction, for the terminal buses, inserted into the main body, for the various current phases.

24. The supply rail according to claim 16, wherein the supply rail comprises three contact bars for three current phases of the busbar system, which bars are connected to three associated terminal buses by means of three connector plates.

25. The supply rail according to claim 24, wherein the supply rail is configured to be mounted transversely on the busbars arranged in parallel, wherein the end face of the elongate main body that has the terminals for electrically connecting to the low-voltage network points downwards or configured to be mounted on the parallel busbars in a manner rotated about 180°, wherein the end face of the elongate body that has the terminals for electrically connecting to the low-voltage network points upwards.

26. The supply rail according to claim 16, wherein the terminals for electrically connecting to the low-voltage network are each provided for at least one cable shoe that is configured to be attached to the terminal lug of the associated terminal.

27. The supply rail according to claim 16, wherein the terminal lugs of the terminals each comprise a clamp for electrically connecting to a round or segmental conductor or a clamp for electrically connecting to a flat conductor.

28. The supply rail according to claim 16, wherein the electrical current supplied via the supply rail has a high current amplitude of more than 1000 A.

29. The supply rail according to claim 16, wherein the elongate main body of the supply rail consists of an electrically insulating plastics part.

30. The supply rail according to claim 16, wherein the contact bars comprise holes or semi-circular notches for fastening to the associated busbar of the busbar system.

31. The supply rail according to claim 16, wherein support brackets for supporting a contact guard cover plate of a switch cabinet are provided on at least one side of the elongate main body or of the contact guard cover of the supply rail.

* * * * *